US008807459B2

(12) United States Patent
Andersen

(10) Patent No.: US 8,807,459 B2
(45) Date of Patent: Aug. 19, 2014

(54) AIRLESS PAINT SPRAY GUN

(76) Inventor: Matthew Andersen, Omaha, NE (US)

( * ) Notice: Subject to any disclaimer, the term of this patent is extended or adjusted under 35 U.S.C. 154(b) by 421 days.

(21) Appl. No.: 13/414,161

(22) Filed: Mar. 7, 2012

(65) Prior Publication Data

US 2013/0233945 A1 Sep. 12, 2013

(51) Int. Cl.

| | |
|---|---|
| ***B05B 7/02*** | (2006.01) |
| ***B05B 9/01*** | (2006.01) |
| ***B05B 1/28*** | (2006.01) |
| ***B05B 15/04*** | (2006.01) |

(52) U.S. Cl.

USPC ..... 239/525; 239/288.5; 239/526; 239/391; 239/394; 239/396

(58) Field of Classification Search

CPC ..... B05B 9/01; B05B 12/002; B05B 1/265; B05B 1/267; B05B 7/02; B05B 7/0425; B05B 7/1218

USPC ..... 239/288.5, 391, 394, 396, 457–458, 239/517, 525–527, DIG. 14

See application file for complete search history.

(56) References Cited

U.S. PATENT DOCUMENTS

| | | | | |
|---|---|---|---|---|
| 3,955,763 | A * | 5/1976 | Pyle et al. | 239/119 |
| 4,165,836 | A | 8/1979 | Eull | |
| 4,331,296 | A | 5/1982 | Levey | |
| 4,715,537 | A | 12/1987 | Calder | |
| 4,757,947 | A | 7/1988 | Calder | |
| 5,280,853 | A | 1/1994 | Perret, Jr. | |
| 5,294,053 | A | 3/1994 | Perret, Jr. | |
| 5,425,506 | A | 6/1995 | Carey | |
| 5,595,451 | A | 1/1997 | Harrison, Jr. | |
| 5,660,332 | A | 8/1997 | Carey et al. | |
| 5,749,528 | A | 5/1998 | Carey et al. | |
| 5,911,364 | A * | 6/1999 | Johnson et al. | 239/119 |
| 6,460,787 | B1 | 10/2002 | Hartle et al. | |
| 6,702,198 | B2 | 3/2004 | Tam et al. | |
| 6,854,667 | B2 | 2/2005 | Ulrich et al. | |
| 6,860,438 | B1 * | 3/2005 | Huang | 239/526 |
| 7,000,855 | B1 * | 2/2006 | Chen | 239/526 |
| 2002/0014541 | A1 | 2/2002 | Krohn et al. | |
| 2006/0118661 | A1 * | 6/2006 | Hartle et al. | 239/691 |
| 2008/0247808 | A1 | 10/2008 | Costigan | |
| 2009/0056622 | A1 | 3/2009 | Potter | |
| 2009/0145980 | A1 * | 6/2009 | Jones | 239/215 |
| 2009/0152378 | A1 | 6/2009 | Potter | |
| 2010/0072300 | A1 * | 3/2010 | Miller et al. | 239/332 |

* cited by examiner

*Primary Examiner* — Justin Jonaitis
*Assistant Examiner* — Thomas Berez
(74) *Attorney, Agent, or Firm* — Dennis L. Thomte; Thomte Patent Law

(57) ABSTRACT

An indexing mechanism is provided for use with a prior art airless paint spray gun. The indexing means of this invention enables the tip guard of the spray gun to be rotated in 90° increments with respect to the frame of the spray gun without loosening the retaining nut of the tip guard.

1 Claim, 8 Drawing Sheets

AIRLESS PAINT SPRAY GUN

BACKGROUND OF THE INVENTION

1. Field of the Invention

This invention relates to an airless paint spray gun wherein the tip guard, having a spray tip associated therewith, may be selectively rotatably moved 90° with respect to the spray gun frame, without loosening the retaining nut of the tip guard, to change the spray pattern of the spray tip from a vertical pattern to a horizontal pattern and vice versa.

2. Description of the Related Art

Airless paint spray guns which are used in hydraulic paint spraying operations normally include a gun head or frame which is fluidly connected to a source of paint under pressure. The gun head has a discharge opening at its upper forward end from which pressurized paint is discharged when the trigger of the spray gun is depressed. A retaining nut housing or thread base is threadably mounted in the discharge opening of the gun head. The prior art spray guns also have a tip guard threadably secured to the thread base by a retaining nut. The tip guard includes a transversely extending tip which has an orifice associated therewith through which the paint is discharged. The tip guard includes a pair of diverging tip guard ears which extend outwardly and forwardly therefrom.

In the prior art devices, the tip guard may be only selectively rotated with respect to the frame of the spray gun when the retaining nut is loosened. The tip guard, when held in a first position, sprays paint in a vertical pattern. The tip guard, when held in a second position, sprays paint in a horizontal pattern.

In the prior art devices, when the painter desires to spray paint in a horizontal pattern rather than a vertical pattern or vice versa, the painter must take his/her hand, which is not holding the spray gun, to loosen the retaining nut, rotate the tip guard 90° and then tighten the retaining nut. If the tip guard is not rotated 90°, the spray pattern will not be the desired spray pattern.

The only alternative in the prior art spray guns when shifting from a vertical spray pattern to a horizontal pattern or vice versa is for the painter to manually rotate the entire spray gun 90° to hold the gun at a 90° angle from the normal painting position.

If the painter is using the spray gun from a ladder, the painter normally holds the spray gun in his/her right hand and grasps the ladder with his/her left hand. If the painter desires to change the tip guard from a vertical spray pattern to a horizontal spray pattern or vice versa, the painter must loosen his/her left hand from the ladder and then loosen the retaining nut, rotate the tip guard 90° and then retighten the retaining nut. The above-described task is not only time consuming but is dangerous since the painter is not grasping the ladder during the time that the tip guard is being adjusted between the horizontal and vertical spray patterns.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An indexing means is provided for use with a prior art airless paint spray gun. The spray gun includes a gun head which is fluidly connected to a source of paint under pressure with the gun head having a discharge opening at its upper forward end from which pressurized paint is discharged when the trigger of the spray gun is depressed. A thread base is threadably mounted in the discharge opening of the gun head. The spray gun includes a tip guard which is threadably secured to the thread base by means of a retaining nut. The tip guard, which includes a spray tip, may be selectively rotated 90° to change the spray pattern from a vertical pattern to a horizontal pattern and vice versa. The tip guard of the prior art spray gun may only be rotated with respect to the gun head by loosening the retaining nut.

An indexing means is provided which is imposed between the thread base and the tip guard which permits the tip guard to be rotated by the painter with his/her finger to change the spray pattern from horizontal to vertical and vice versa without loosening the retaining nut of the tip guard.

It is therefore a principal object of the invention to provide an indexing means for an airless paint spray gun which permits the tip guard thereof to be easily rotated in 90° increments to change the spray pattern of the spray gun from horizontal to vertical and vice versa.

A further object of the invention is to provide an indexing means for an airless paint spray gun which may be imposed between the thread base of the spray gun and the tip guard of the spray gun.

A further object of the invention is to provide a device of the type described which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
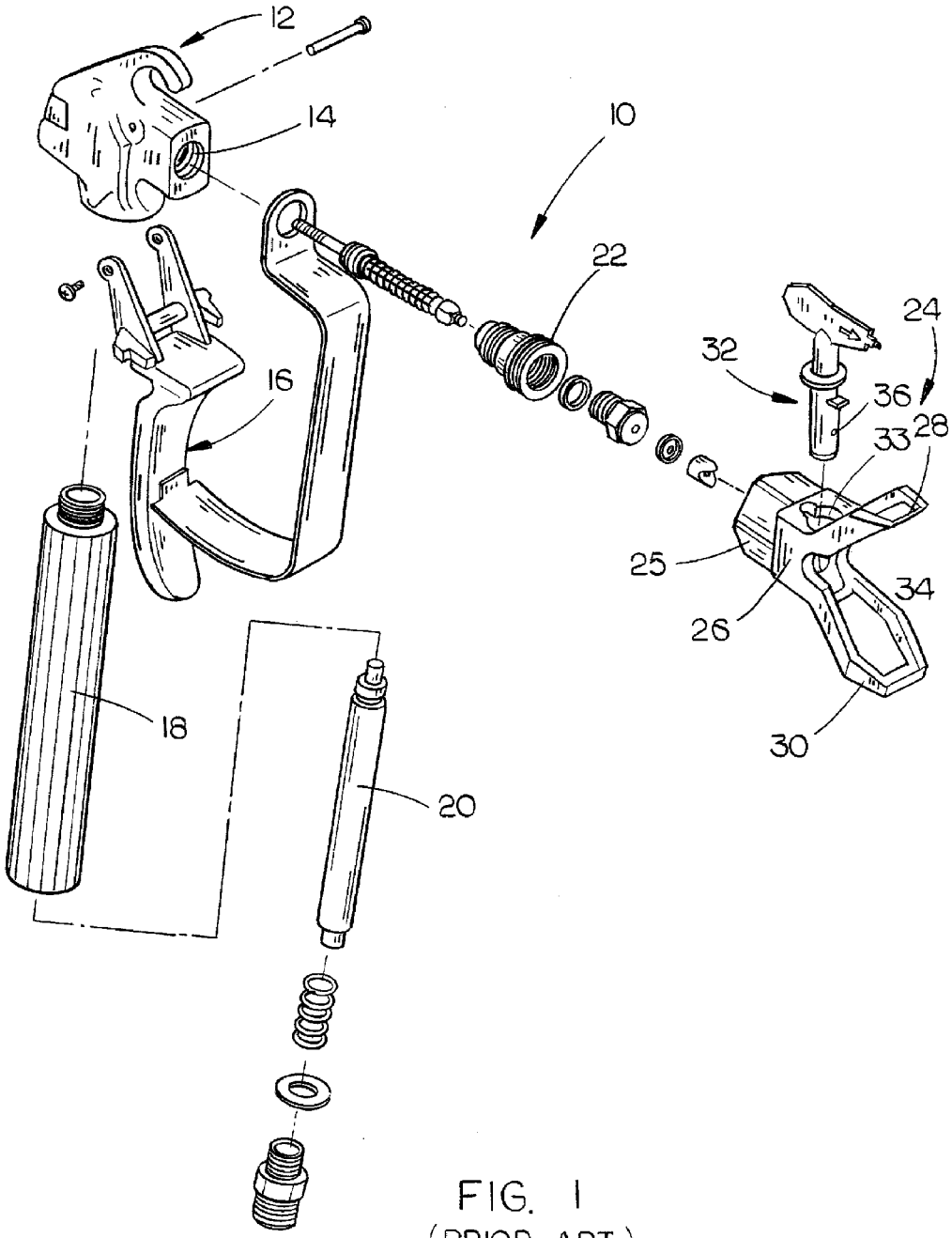
FIG. 1 (PRIOR ART)
FIG. 1 is a partial perspective exploded view of a typical prior art spray gun.
Figure 2:
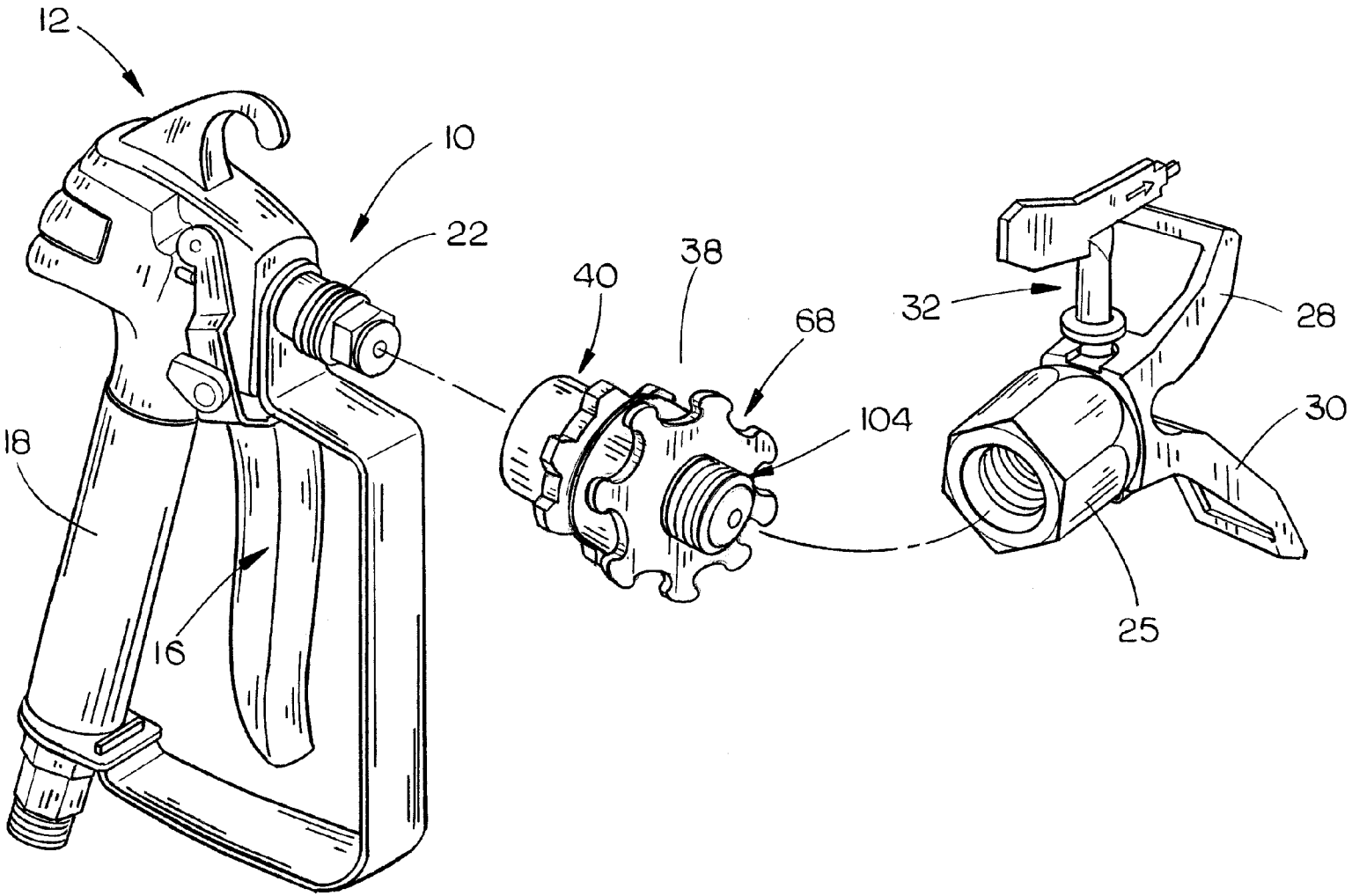
FIG. 2 is an exploded perspective view illustrating the indexing means of this invention being imposed between the tip guard and the frame of the spray gun.
Figure 3:
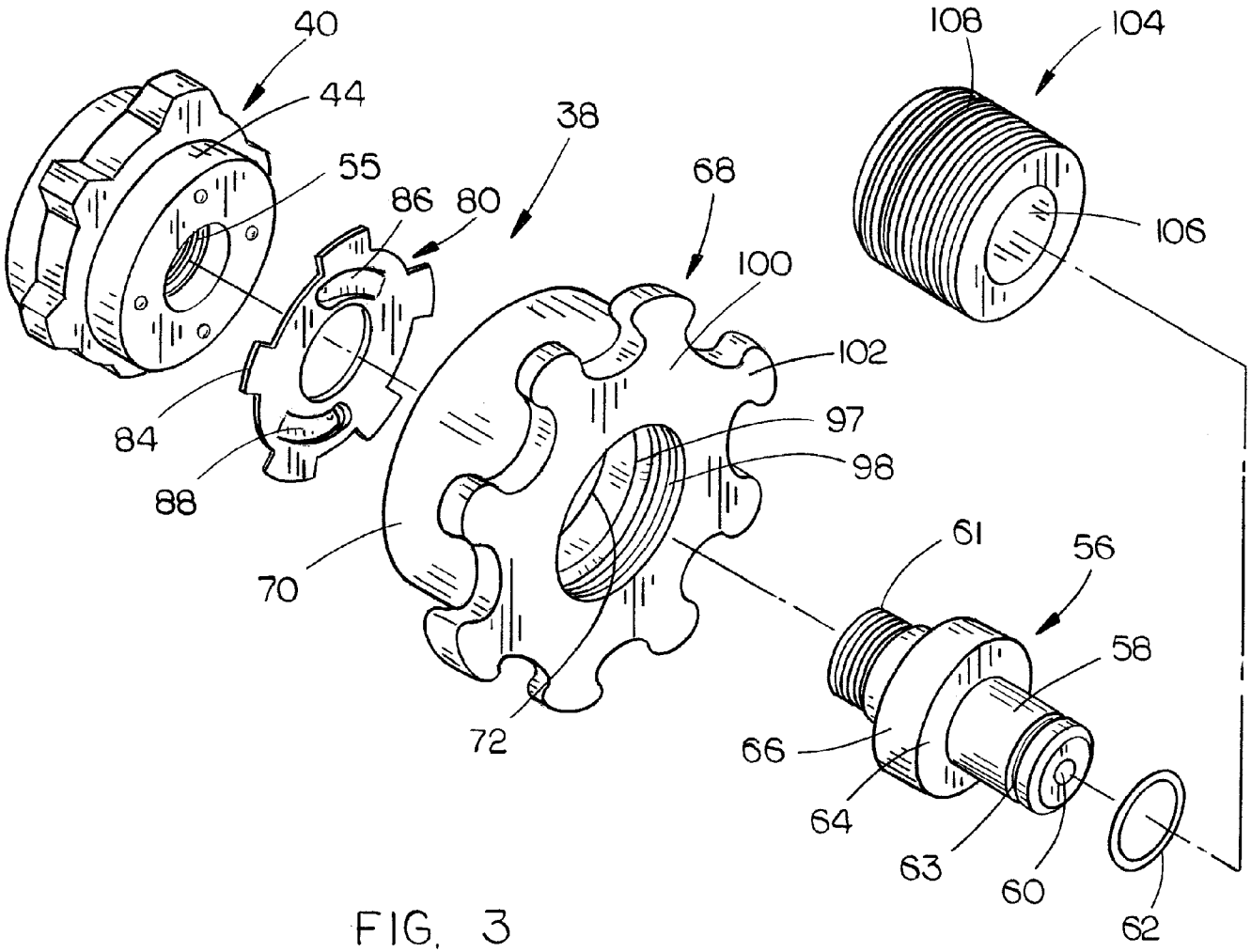
FIG. 3 is an exploded perspective view of the indexing means of this invention.
Figure 4:
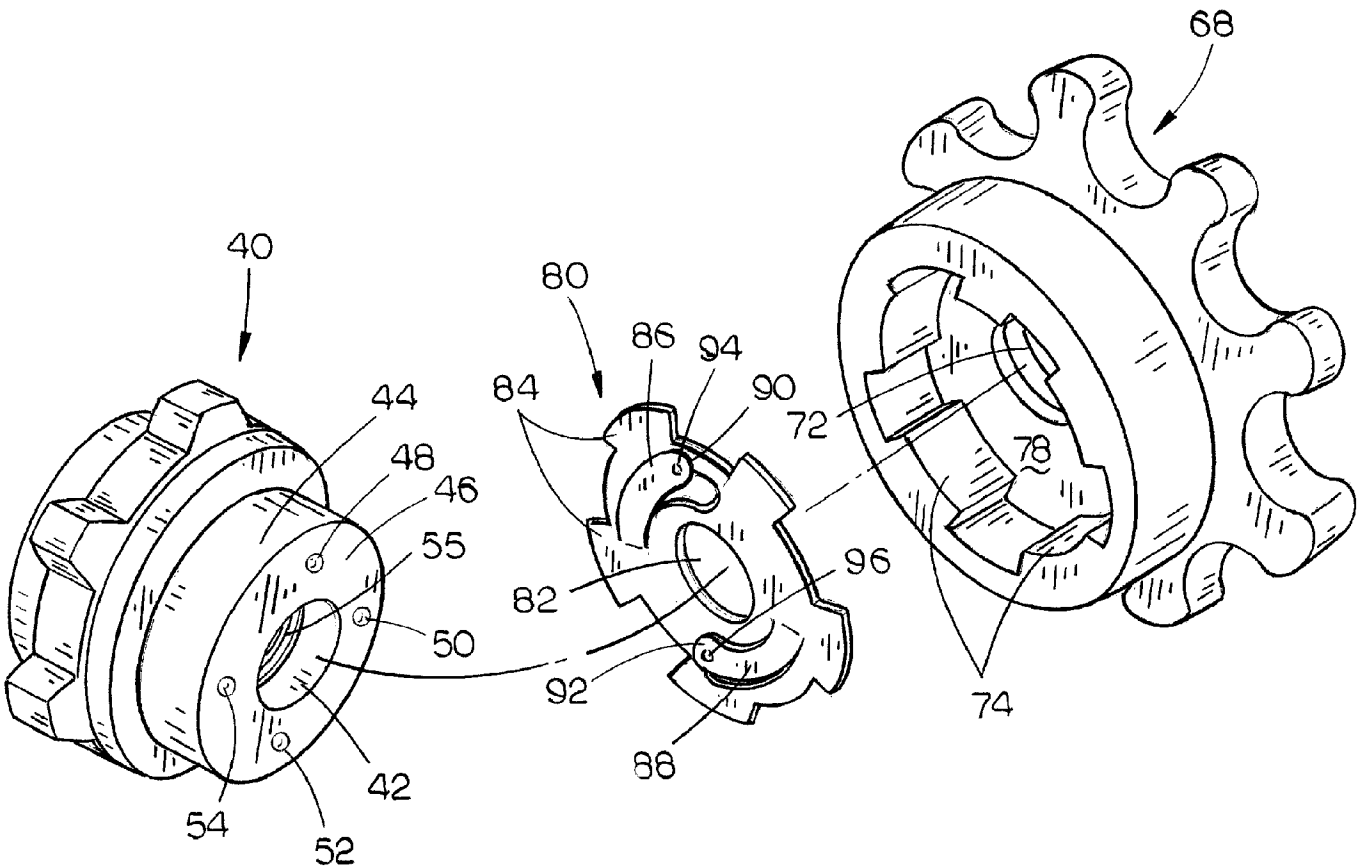
FIG. 4 is another exploded perspective view of the indexing means of this invention.
Figure 5:
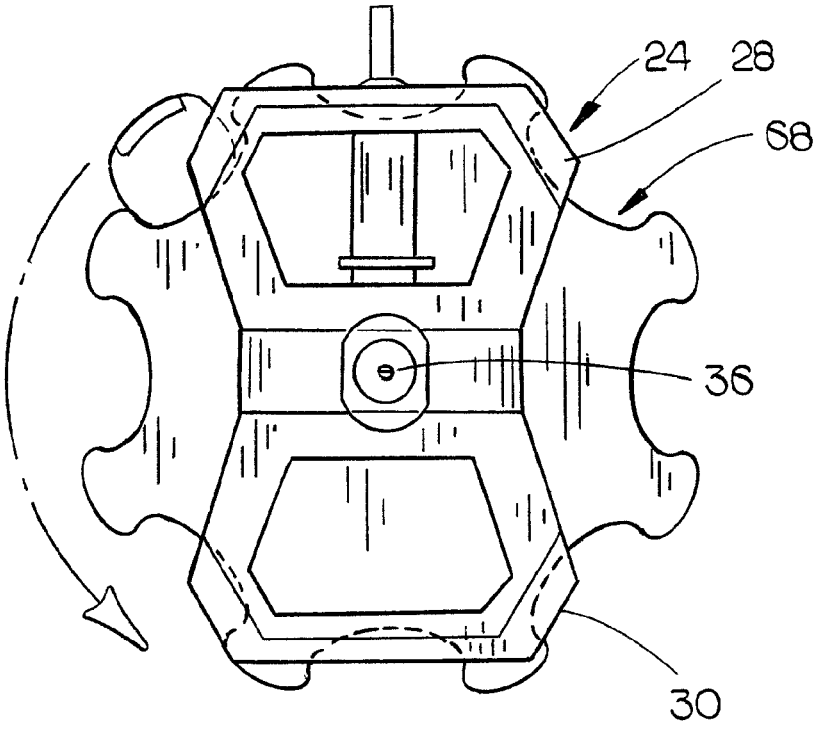
FIG. 5 is an end view of the tip guard wherein the spray tip will discharge paint in a horizontal pattern.

In FIG. 1, the numeral 10 refers to a prior art airless paint spray gun such as marketed by Titan Tool. Spray gun 10 includes a gun head or gun frame 12 having a threaded discharge opening 14 formed therein, a trigger assembly 16 and a handle 18 having a filter 20 therein. The lower end of handle 18 is connected to a source of paint under pressure by a flexible hose 21. The upper discharge end of handle 18 is fluidly connected to an intake opening formed in the lower end of gun head 12. A retainer nut housing or thread base 22 is threadably secured to the threaded discharge opening 14. In FIG. 1, the numeral 24 refers to a conventional tip guard assembly. Tip guard assembly 24 includes a split retainer nut 25 which is rotatably secured to a base 26 having diverging tip guard members or ears 28 and 30 extending therefrom. A spray tip turret 32 is received in a transversely extending bore 33 formed in base 26 which communicates with a forwardly extending bore 34. Tip turret 32 includes an elongated discharge orifice slit 36 to spray paint therefrom in a fan-like pattern which is horizontally disposed when the tip guard members are vertically disposed as seen in FIGS. 1 and 5.

When retaining nut 25 is tightened onto thread base 22, the base 26 and guard members 28 and 30 are held in position. When it is desired to convert the spray pattern from a horizontal pattern to a vertical pattern, the retaining nut 26 must be loosened from thread base 22 so that the painter may manually rotate the spray guard 90°. Since the spray gun is being held in one hand by the painter, the painter must take his/her other hand, loosen nut 25, rotate tip guard 24 ninety degrees, and retighten nut 25. If the painter is holding onto a ladder with his/her other hand, the painter must release his/her grip on the ladder to perform the rotation task. If the painter does not desire to do the above outlined task, he/she must rotate the gun 90° which is difficult and tiresome due to the weight of the paint hose 21 hanging from handle 18. It is for these reasons, Applicant has provided a device which permits the painter to rotate the tip guard 90° with the same hand which is grasping the spray gun without loosening the retaining nut 25.

The indexing structure or mechanism of this invention is referred to generally by the reference numeral 38. Indexing mechanism 38 is imposed between the thread base 22 and the split retainer nut 25 as will now be described. Indexing mechanism 38 includes a mounting nut 40 having an axial bore 42 extending between the rearward end of nut 40 and the forward end of nut 40. Nut 40 has an internally threaded portion 43 at the rearward end of the bore 42 which is threadably mounted on the forward end of thread base 22. Nut 40 has a reduced diameter portion 44 at its forward end which has a flat face 46 at the forward end thereof. Face 46 has four indentations 48, 50, 52 and 54 formed therein which are radially spaced-apart 90° from one another. The forward end of thread base 42 is internally threaded at 55.

The numeral 56 refers to an elongated central shaft including a tubular body portion 58 having an axial bore 60 extending therethrough. The rearward end of tubular body portion 58 has external threads 61 which are threadably received by the internal threads of thread base 55 so that central shaft 56 is fixed against rotation to nut 40.

The forward end of tubular body portion 58 preferably has an O-ring 62 mounted in an annular groove or channel 63 formed therein. Central shaft 56 has a transversely extending, ring-shaped shoulder 64 intermediate the ends thereof which provides a bearing surface 66 on the periphery thereof.

Indexing means 38 also includes a central body 68 having a hub portion 70 with rearward and forward ends. An axial bore 72 extends through hub portion 70. The inner rearward end of hub portion 70 is provided with a plurality of radially spaced-apart splines 74 which extend forwardly to a wall 78.

Indexing means 38 also includes a disc-like detent spring 80 having a rearward face and a forward face. Detent spring 80 has a central bore 82 which receives the inner end of body portion 58 so that spring 80 is rotatably mounted thereon adjacent the face 46 of mounting nut 40. Spring 80 has a plurality of splines 84 which are received between the splines 74 of hub portion 70 so that the rotation of central body 68 with respect to central shaft 56 will also cause detent spring 80 to rotate therewith. Spring 80 is positioned adjacent the rearward side of wall 78 as seen. Spring 80 includes spring arms 86 and 88 having free ends 90 and 92 respectively which project rearwardly from the rearward side thereof.

The rearward sides of the free ends 90 and 92 of spring arms 86 and 88 have detent projections 94 and 96 extending rearwardly therefrom respectively which are adapted to be yieldably received by the indentations 48, 50, 52 and 54 as will be described in more detail hereinafter.

The inner forward end of central body 68 has an annular bearing support surface 97 formed therein. Central body 68 also has internal threads 98 formed therein forwardly of bearing support surface 97. An actuator ring 100 extends radially outwardly from hub portion 70 at the forward end thereof. The outer periphery of actuator ring 100 has a plurality of spaced-apart knobs 102 formed thereon.

The numeral 104 refers to a thread base having an internal bore 106 extending therethrough. Thread base 104 has external threads 108 formed thereon.

Figure 7:
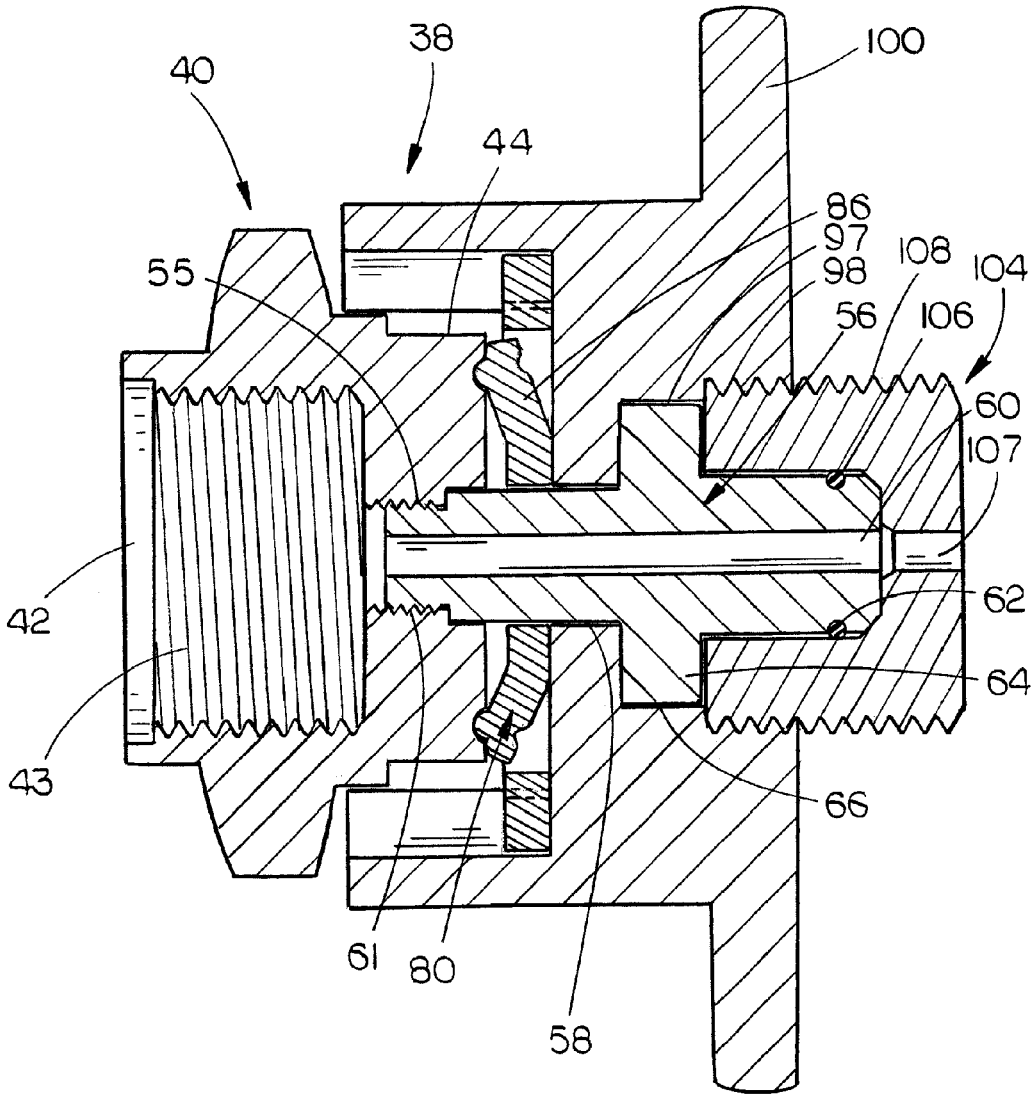
FIG. 7 is a sectional view of the indexing means of this invention.
Figure 8:
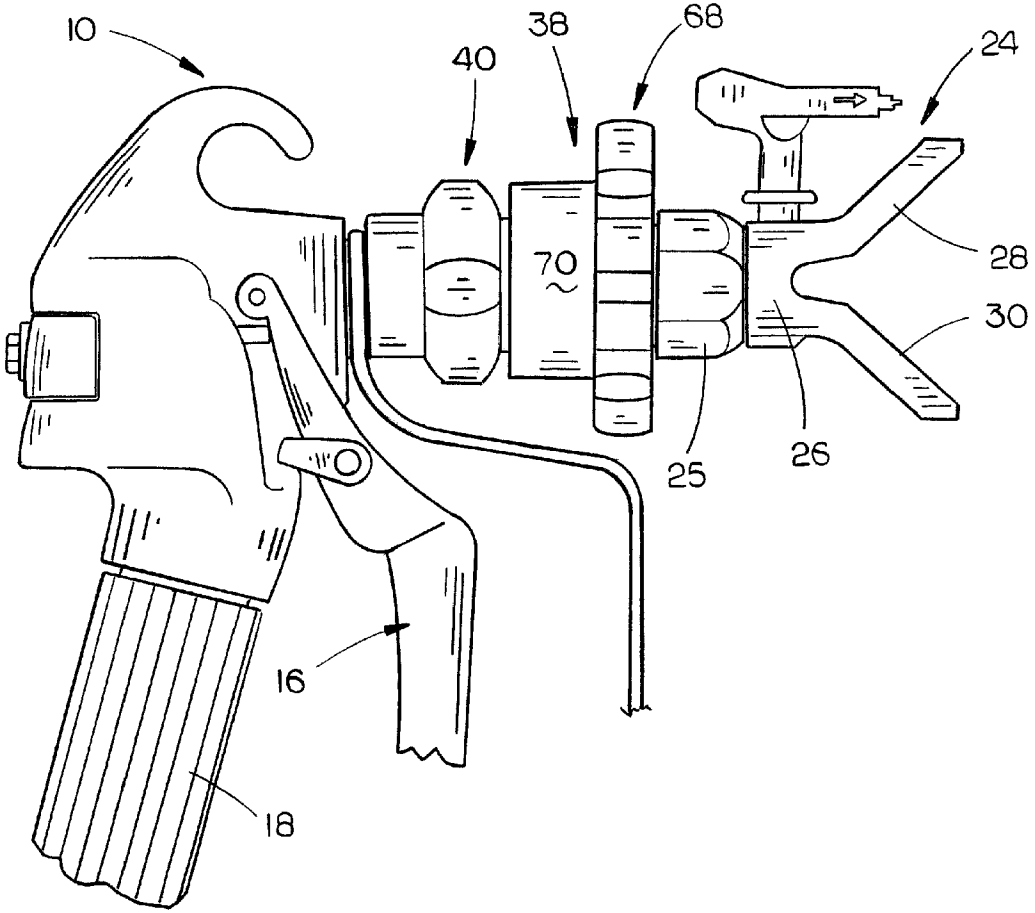
FIG. 8 is a side view illustrating the indexing means of this invention imposed between the tip guard and the frame of the spray gun.

The indexing means 38 is assembled as follows. Detent spring 86 is inserted into the rearward end of hub portion 10 of central body 68 so that the splines 84 of detent spring 80 are received between the splines 74 of hub portion 70 and so that the forward face of detent spring 80 is in engagement with wall 78 in hub portion 70. The rearward end of central shaft 56 ins inserted into the forward end of bore 72 until bearing surface 66 of central shaft 56 is in engagement with bearing surface 97 of hub portion 70. The forward end of nut 40 is then threaded onto the external threads 61 of central shaft 56. At that time, the free ends of spring arms 86 and 88 will be in engagement with face 46 of nut 40. The rearward end of thread base 104 is then threadably secured to the internal threads 98 of hub portion 70 with the forward end of tubular portion 58 of central shaft 56 being received in thread base 104 as seen in FIG. 7. Thus, when assembled as seen in FIG. 7, the hub portion 70, actuator ring 100 and detent spring 80 may be rotated with respect to central shaft 56 which is fixed to nut 40.

The guard 24 is disconnected from the thread base 22 by unthreading retaining nut 25 from thread base 22. The nut 40 is then threaded onto the thread base 22 so that nut 40 and central shaft 56 are fixed against rotation to the spray gun 10. The retaining ring 100 and hub portion 70 are then rotated until the projections 94 and 96 on spring arms 86 and 88 respectively are received in a pair of opposing indentations 48,52 or 50, 54 or 52, 48 or 54, 50. The tip guard 24 is then secured to the indexing means 38 by threading the nut 25 onto thread base 104, the base 26 is rotated until the ears 28 and 30 of tip guard 24 are vertically aligned such as seen in FIG. 5. The nut 25 is then completely tightened onto thread base 104.

Figure 6:
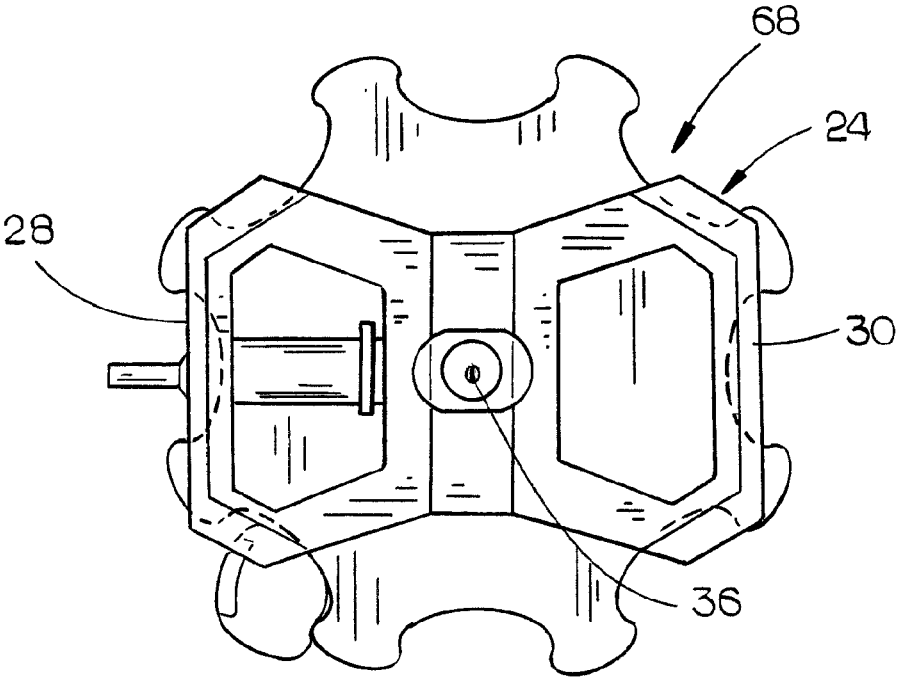
FIG. 6 is a view similar to FIG. 5 except that the tip guard has been rotated 90° so that the spray tip will discharge the paint therefrom in a vertical pattern.
Figure 9:
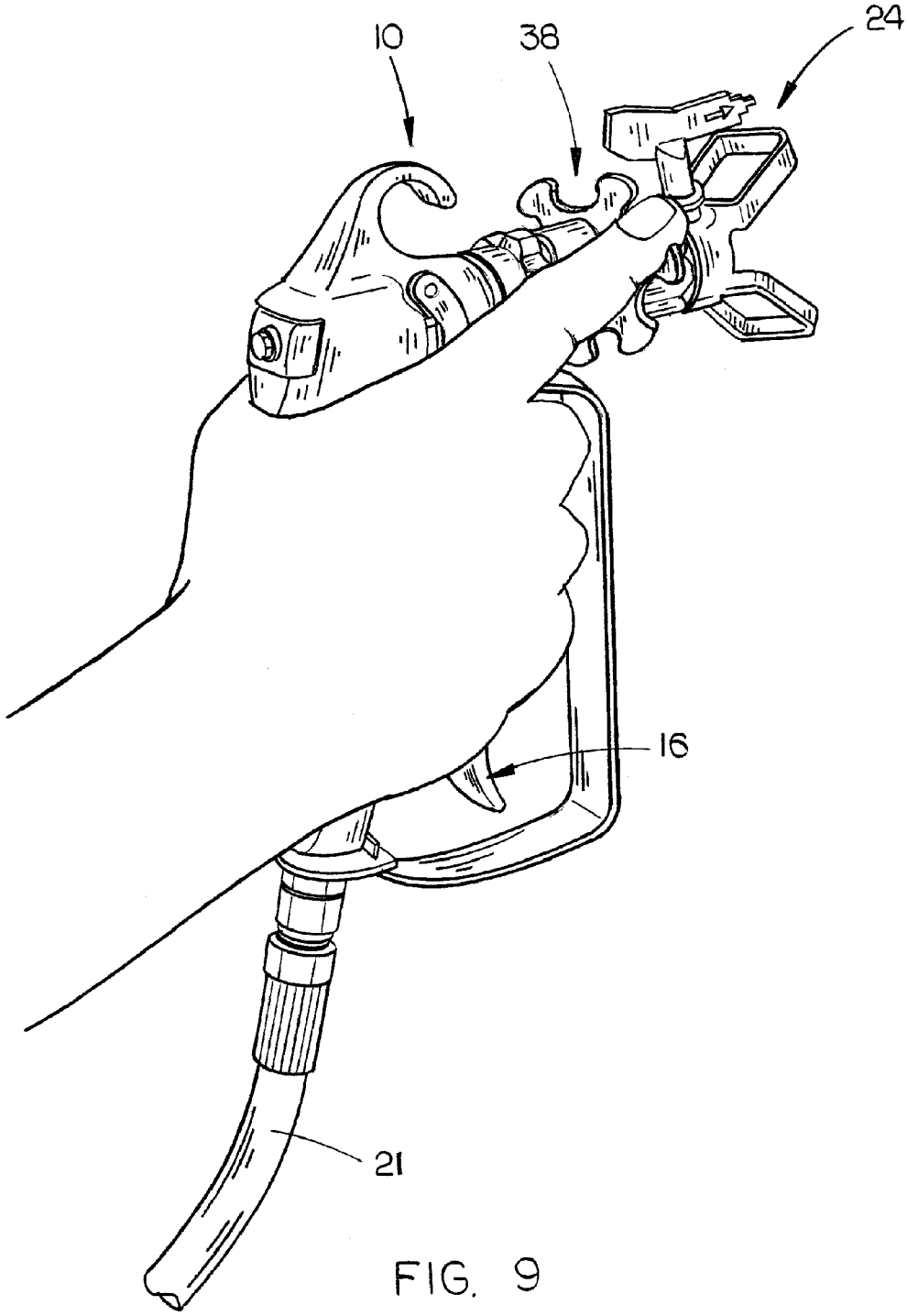
FIG. 9 is a perspective view illustrating the manner in which the painter may rotate the indexing means with his/her index finger to change the spray pattern from vertical to horizontal or vice versa.

In use, the vertical positioning of the ears 28 and 30, as seen in FIG. 5, will cause the paint to be sprayed from the orifice 36 in a fan-like horizontal pattern. As seen in FIG. 9, the spray gun 10 is held by one hand of the painter. Should the painter desire to change the spray pattern from horizontal to vertical, the painter places his/her index finger between a pair of the knobs 102 on retaining ring 100 and rotate the retaining ring 100 in a clockwise manner, as viewed in FIG. 9, which will rotate the detent spring 80 with respect to face 46 of nut 40. The painter will continue to rotate retaining ring 100 until he/she feels the projections 94 and 96 engaging the next pair of opposing indentations which are positioned 90° from the previous pair of opposing indentations. When the painter has rotated the tip guard 90°, the ears 28 and 30 will be positioned as seen in FIG. 6 so that the orifice 36 will discharge the paint in a vertical pattern.

It can be seen that the indexing means 38 of this invention permits the painter to quickly and easily change the spray patterns without loosening the nut 25 as is necessary in the prior art spray guns. The retaining ring 100 is positioned conveniently within reach of the painter's index finger. It can therefore be seen that the invention accomplishes at least all of its stated objectives. Although FIG. 9 shows the spray gun being held by the right hand of the painter, the painter could also hold the spray gun in his/her left hand. If the spray gun is being held in the painter's left hand, the painter will use his/her left index finger to rotate the retaining ring in a counter clockwise direction.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination:

an airless paint spray gun including a gun housing with an internally threaded discharge opening;

a first thread base having rearward and forward ends;

said first thread base having an externally threaded rearward end which is threadably secured to said internally threaded discharge opening of said gun housing;

said first thread base having external threads at said forward end thereof;

said first thread base having a bore extending between said rearward and forward ends thereof;

a mounting nut having rearward and forward ends;

said forward end of said mounting nut having a forwardly extending reduced diameter portion;

said mounting nut having a bore extending between said rearward and forward ends;

said rearward end of said mounting nut being threadably secured to said forward end of said first thread base;

said mounting nut having a flat annular surface at said forward end thereof;

said flat annular surface of said mounting nut having first, second, third and fourth indentations formed therein which are radially spaced-apart 90° from one another;

an elongated central shaft including a tubular body portion having rearward and forward ends with a bore extending between said rearward and forward ends thereof;

said rearward end of said tubular body portion of said central shaft having external threads;

said central shaft having an annular shoulder extending transversely outwardly from said tubular body portion intermediate said rearward and forward ends thereof to define a first bearing surface at the outer end thereof;

said rearward end of said tubular body portion being threadably secured to said forward end of said mounting nut;

a central body having rearward and forward ends;

said central body including a hub portion, with rearward and forward ends, and an actuator ring extending transversely outwardly from said hub portion;

a disc-like detent spring having a rearward side, a forward side, and a central opening;

said detent spring being rotatably mounted on said tubular body portion of said central shaft rearwardly of said annular shoulder of said central shaft;

said detent spring having first and second spring arms having free ends which protrude rearwardly of said rearward side of said detent spring;

each of said free ends of said first and second spring arms having a protrusion thereon which is adapted to be yieldably received by one of said indentations in said flat annular surface of said mounting nut;

said detent spring being positioned in said hub portion of said central body at the rearward end thereof for rotation with said central body;

said rearward end of said hub portion of said central body being rotatably mounted on said reduced diameter portion of said mounting nut;

said central body having a second bearing surface inwardly of said forward end thereof which receives said first bearing surface of said center shaft;

said hub portion of said central body having internal threads at said forward end thereof;

a second thread base having rearward and forward ends;

said second thread base having a bore extending therethrough;

the rearward end of said base of said second thread base receiving said forward end of said central shaft;

said rearward end of said second thread base being threadably secured to said internal threads at said forward end of said hub portion of said central body for rotation therewith;

a tip guard assembly having rearward and forward ends;

said tip guard assembly including a base having rearward and forward ends;

said base having a central axial opening;

a pair of diverging tip guard members extending forwardly from said base;

said tip guard assembly including a retaining nut rotatably secured to said rearward end of said base;

said retaining nut being threadably secured to said externally threaded forward end of said second thread base;

said base and said diverging tip guard members being fixed against rotation with respect to said second thread base when said retaining nut is tightened onto said second thread base;

said base and said diverging tip guard members being rotatable with said second thread base when said actuator ring is rotated under said retaining nut and has been threadably tightened onto said second thread base;

said tip guard assembly including a spray tip which sprays paint therefrom in a generally fan shape generally transverse to said diverging tip guard members;

said base and said diverging tip guard members being selectively rotatable in 90° increments by the selective rotation of said actuator ring, said central body and said detent spring without said retaining nut being loosened with respect to said second thread base.

* * * * *